US006954994B1

(12) United States Patent
Teo et al.

(10) Patent No.: US 6,954,994 B1
(45) Date of Patent: Oct. 18, 2005

(54) MOISTURE REMOVAL MECHANISM

(75) Inventors: Cherng Linn Teo, Singapore (SG); Eng Guan Yeo, Singapore (SG); Seng San Koh, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/882,710

(22) Filed: Jun. 30, 2004

(51) Int. Cl.[7] ..... F26B 3/00

(52) U.S. Cl. ..... 34/448; 34/463; 34/216; 34/217; 34/218

(58) Field of Search ..... 34/448, 463, 216, 34/217, 218; 165/231; 101/148, 487

(56) References Cited

U.S. PATENT DOCUMENTS 3,882,612 A * 5/1975 Try et al. ..... 34/479
4,432,147 A * 2/1984 Chen et al. ..... 34/542
4,534,118 A * 8/1985 Cabus et al. ..... 34/514
4,569,658 A * 2/1986 Wiggins et al. ..... 432/47
4,862,599 A * 9/1989 Brunner ..... 34/536
4,999,927 A * 3/1991 Durst et al. ..... 34/448
5,003,961 A * 4/1991 Besik ..... 126/110 R
5,325,604 A * 7/1994 Little ..... 34/493
5,992,048 A * 11/1999 DeVore et al. ..... 34/522
6,176,305 B1 * 1/2001 Haglid ..... 165/231

* cited by examiner

*Primary Examiner*—Stephen Gravini

(57) ABSTRACT

A moisture removal mechanism comprises a drying zone through which product to be dried passes. A fluid circulation path is in fluid communication with the drying zone. A forced fluid feed device directs drying fluid to and from the drying zone, the fluid feed device being mounted in the fluid circulation path. A heater is arranged in the fluid circulation path for heating the drying fluid prior to entry of the fluid into the drying zone. A fluid control arrangement is arranged in the fluid circulation path for controlling moisture content of the drying fluid, the fluid control arrangement being responsive to flow of fluid in the fluid circulation path.

15 Claims, 2 Drawing Sheets

MOISTURE REMOVAL MECHANISM

FIELD

This invention relates generally to moisture removal and, more particularly, to a moisture removal mechanism.

BACKGROUND

In image recording devices, an image is generated on product in the form of print media. Often the image is generated by way of a material containing a liquid which wets the print media. It is therefore necessary to dry the print media before discharging it from the image recording device.

Drying of the print media may be effected by way of blowing a gas on to the print media to cause evaporation of liquid in or on the print media. The vapor so generated is then entrained in the gas. The gas containing the vapor in suspension requires treatment to remove the vapor. This may be done by way of a heat exchanger and subsequent removal of the condensed vapor. The use of a heat exchanger adds to the complexity, cost and size of the image recording device.

SUMMARY

A moisture removal mechanism comprises a drying zone through which product to be dried passes. A fluid circulation path is in fluid communication with the drying zone. A forced fluid feed device directs drying fluid to and from the drying zone, the fluid feed device being mounted in the fluid circulation path. A heater is arranged in the fluid circulation path for heating the drying fluid prior to entry of the fluid into the drying zone. A fluid control arrangement is arranged in the fluid circulation path for controlling moisture content of the drying fluid, the fluid control arrangement being responsive to flow of fluid in the fluid circulation path.

DETAILED DESCRIPTION OF EXEMPLARY EMBODIMENT

Figure 1A:
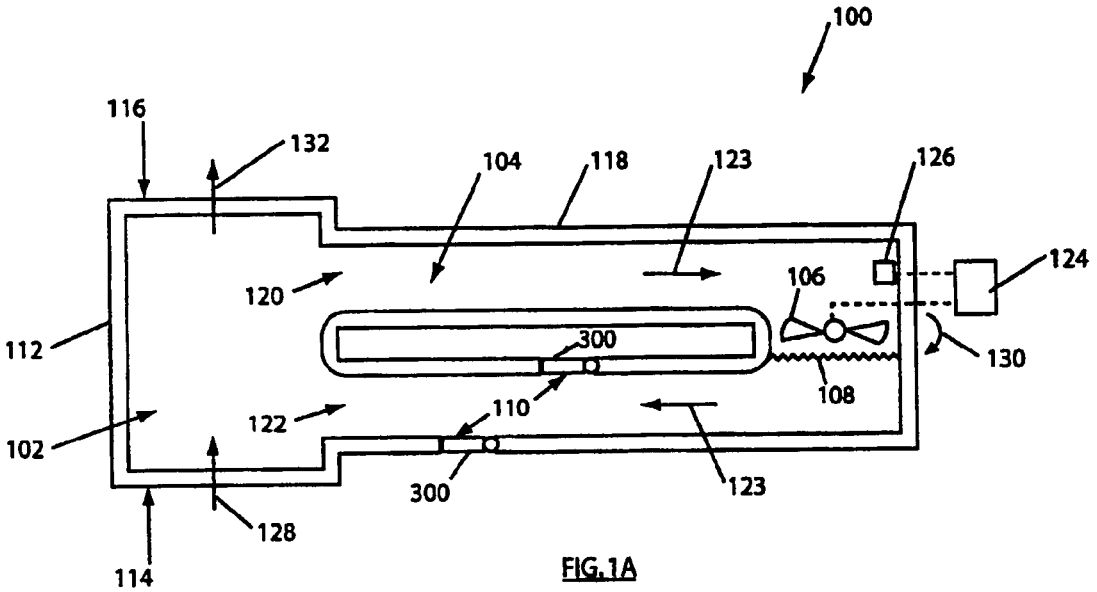
FIG. 1A shows a schematic representation of a moisture removal mechanism, in accordance with an embodiment of the present invention, with a flow control arrangement of the mechanism in a first condition.
Figure 1B:
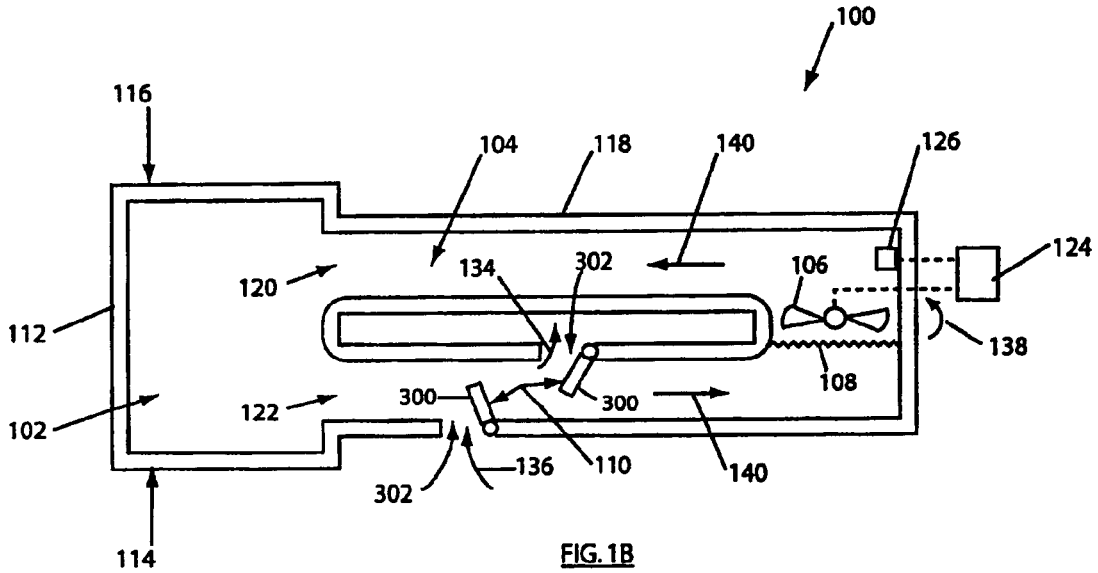
FIG. 1B shows a schematic representation of the moisture removal mechanism with the flow control arrangement of the mechanism in a second condition.

In FIGS. 1A and 1B of the drawings, reference numeral 100 generally designates a moisture removal mechanism. The moisture removal mechanism 100 includes a drying zone 102. A fluid circulation path 104 is in fluid communication with the drying zone 102. A forced fluid feed device in the form of a fan 106 is mounted in the fluid circulation path 104. A heater 108 is arranged proximate the fan 106 for heating drying fluid prior to entry of the drying fluid into the drying zone 102, as will be described in greater detail below.

The mechanism 100 includes a fluid control arrangement 110, a part of which is arranged in the fluid circulation path 104. The drying zone 102 is defined by a chamber defining unit 112 having an inlet opening 114 and an outlet opening 116. In this regard it will be noted that the moisture removal mechanism 100 forms part of an image recording device (not shown). In this specification, the term "image recording device" is to be understood in a broad sense as any device which records images on print media. Thus, the image recording device could be in the form of an image reproduction device such as a copier, facsimile machine, scanner, or the like or an image generation device such as a printer, more particularly, an inkjet printer. In general, the image recording device is to be understood as any device where print media, such as paper, is wetted by ink.

In an embodiment, the moisture removal mechanism 100 is a hermetically sealed unit apart from the inlet opening 114 and the outlet opening 116. However, the inlet opening 114 and the outlet opening 116 are both very narrow effectively to reduce the amount of drying fluid that can escape from the drying zone 102.

The fluid circulation path 104 is defined by a conduit 118. The conduit 118 has a first opening 120 in communication with the drying zone 102 and a second opening 122, spaced from the first opening 120, the opening 122 also being in communication with the drying zone 102.

Figure 3:
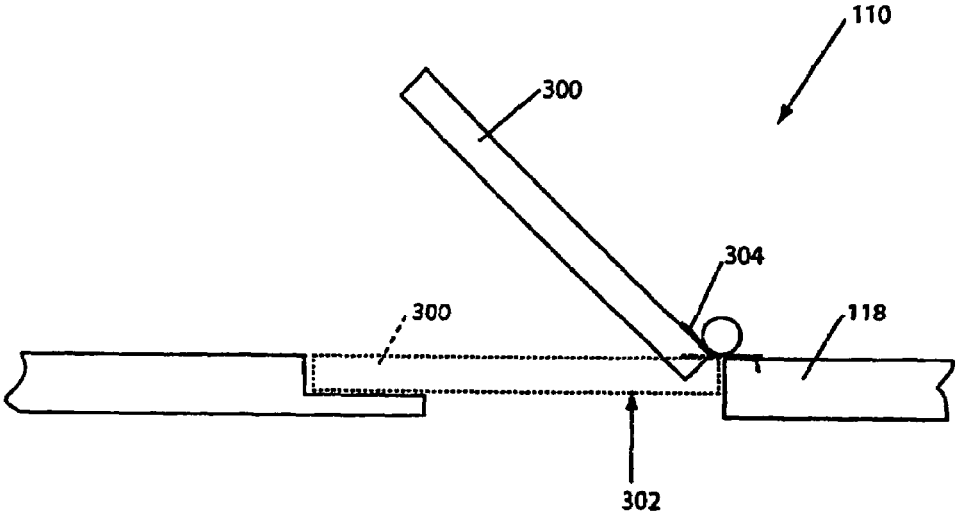
FIG. 3 shows a schematic representation of the flow control arrangement of the moisture removal mechanism.

The fluid control arrangement 110 includes a pair of doors 300 (FIG. 3). Each door closes off an opening 302 in a wall of the conduit 118. Each door 300 is a normally open door which is retained in a normally open position by an urging device in the form of a coil spring 304, the spring 304 holding the door 300 in an open orientation or configuration when there is an absence of fluid flow in the conduit 104 in the direction of arrows 123 (FIG. 1A). Thus, the spring 304 is selected to have a very weak spring force so that fluid flow in the direction of the arrows 123 causes the doors 300 to move from the position shown in solid lines to the position shown in dotted lines in FIG. 3 of the drawings to close off the openings 302.

The fluid control arrangement 110 further includes a controller 124 for controlling the direction of rotation of the fan 106 and, hence, the direction of fluid flow in the fluid circulation path 104. In addition, the fluid control arrangement 110 includes a sensor 126 which monitors the condition of the fluid in the fluid path 104.

Figure 2:
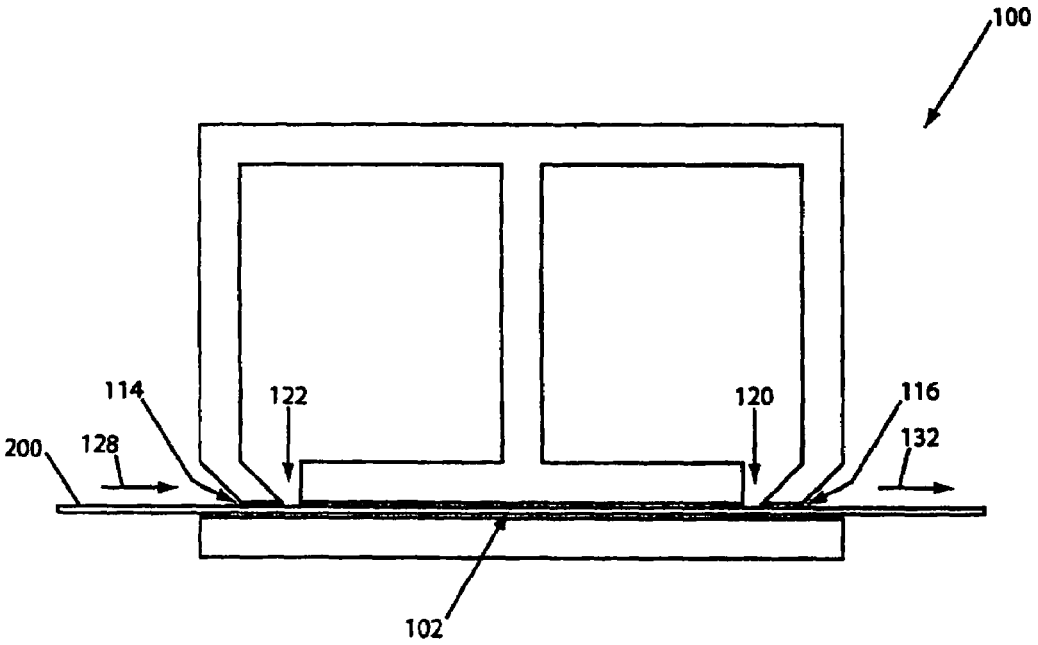
FIG. 2 shows a schematic sectional side view of a part of the mechanism.

In use, print media 200 (FIG. 2), such as wetted paper to be dried, is fed into the drying zone 102 through the inlet opening 114 in the direction of arrow 128. However, prior to drying of the print media 200 commencing, the fan 106 is idle. Consequently, because there is no fluid flow in the fluid circulation path 104, the doors 300 are open and fresh, dry air (the drying fluid) enters the fluid circulation path 104 from atmosphere through the doors 300.

The controller 124 activates the fan 106 so that the fan 104 rotates in the direction of arrow 130. The air in the conduit 118 moves in the direction of arrows 123 over the heater 108 where the air is heated. The air flow in the fluid circulation path 104 overcomes the resistance offered by the spring force of each of the springs 304 causing the doors 300 to close.

The air, heated by the heater 108, flows through the opening 122 into the drying zone 102 on to the paper 200 in the drying zone 102. The hot air causes drying of the paper 200 by evaporation of liquid on or in the paper 200. The moisture laden air then travels through the opening 120 back towards the fan 106.

After the paper 200 has been dried, the paper 200 moves out of the drying zone 102 through the outlet opening 116 in the direction of arrow 132. The moisture laden air, being hotter than the ambient air, recirculates and assists in heating up any further air in the fluid circulation path 104 or drying zone 102 to aid in drying the following product entering the drying zone 102. This still-hot air therefore reduces the energy consumption of the mechanism 100 as the hot air assists in heating up any further air to the desired temperature.

After air has circulated through the drying zone 102 and fluid circulation path 104 for a certain period of time, the moisture content of the air increases and eventually reduces the drying efficiency of the air. The moisture content of the air is monitored by the sensor 126 which may be a humidity sensor. When the sensor 126 detects that the moisture content of the air is at or beyond a threshold value, the sensor 126 sends an appropriate signal to the controller 124. The controller 124 stops the fan 106. As a result, fluid flow in the fluid circulation path 104 ceases. When this occurs, the doors 300 open under the effect of their springs 304. The moisture laden air vents to atmosphere through one of the doors 300 in the direction of arrow 134. Dry, ambient air is drawn in through the other of the doors 300 as shown by arrow 136.

To assist in venting the moisture laden air to atmosphere and to draw in dry air, the controller 124 causes the fan to reverse its direction of rotation so that it now rotates in the direction of arrow 138. This causes air to circulate in the direction of arrows 140 in the fluid circulation path 104 assisting in the moisture laden air being expelled and dry air being drawn into the fluid circulation path 104.

After the fluid circulation path 104 has been replenished with dry air, the controller 124 stops rotation of the fan 106 in the direction of arrow 138 and reverses the direction of rotation of the fan 106 so that it again rotates in the direction of arrow 130. This causes the doors 300 to close and the drying process can be repeated.

The rate of air replacement in the fluid circulation path 104 is dependent on natural convective flow and on ambient conditions. However, by reversing the direction of rotation of the fan 106, the rate of fresh air replacement and moisture removal is increased.

It is a particular advantage of the invention that a moisture removal mechanism 100 is provided which significantly reduces the complexity of the image recording device, has very few moving parts and, as a result, operates more efficiently and with the improved reliability.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. An image recording device comprising:

means for recording an image on a print medium;

a drying zone through which the print medium passes;

a fluid circulation path in fluid communication with the drying zone;

a forced fluid feed device for directing drying fluid to and from the drying zone, the fluid feed device being mounted in the fluid circulation path;

a heater in the fluid circulation path for heating the drying fluid prior to entry of the fluid into the drying zone; and a fluid control arrangement arranged in the fluid circulation path for controlling moisture content of the dying fluid, the fluid control arrangement being responsive to flow of fluid in the fluid circulation path.

2. The mechanism of claim 1 in which the drying zone comprises a chamber defining unit defining a drying chamber.

3. The mechanism of claim 2 in which the fluid circulation path comprises a conduit looping off the chamber defining unit, the conduit having an inlet opening and an outlet opening in a wall of the chamber defining unit, the outlet opening being spaced from the inlet opening.

4. The mechanism of claim 3 in which the forced fluid feed device comprises a fan mounted in the conduit remote from the drying chamber.

5. The mechanism of claim 4 in which the heater is arranged in the conduit in proximity to the fan to effect heating of the drying fluid prior to entry of the drying fluid into the drying chamber.

6. The mechanism of claim 3 in which the fluid control arrangement comprises at least one fluid flow responsive closure member arranged in a wall of the conduit.

7. The mechanism of claim 6 in which the at least one closure member is a normally open member being retained in an open configuration by an urging element in the absence of fluid flow in the conduit.

8. The mechanism of claim 7 in which the urging element is selected to have an urging force which is weaker than the effect of the flow of drying fluid in the conduit so that flow of the drying fluid overcomes the effect of the urging element to force the urging element into a closed configuration.

9. The mechanism of claim 1 in which the fluid control arrangement includes a controller that controls operation of the forced fluid feed device to cause the forced fluid feed device to assist in the replacement of moisture laden fluid by fresh fluid.

10. A printer comprising means for printing on a print medium;

a drying zone through which the print medium passes;

a fluid circulation path in fluid communication with the drying zone;

a forced fluid feed device for directing drying fluid to and from the drying zone, the fluid feed device being mounted in the fluid circulation path;

a heater in the fluid circulation path for heating the drying fluid prior to entry of the fluid into the drying zone; and a fluid control arrangement arranged in the fluid circulation path for controlling moisture content of the drying fluid, the fluid control arrangement being responsive to flow of fluid in the fluid circulation path.

11. A method of drying a print medium comprising:

passing a print medium wetted by ink through a drying zone;

circulating drying fluid through the drying zone;

heating the drying fluid prior to entry of the fluid into the drying zone; and controlling the moisture content of the fluid passing through the drying zone by periodically expelling moisture laden fluid and replacing it with fresh drying fluid, the fluid being expelled and replaced through a fluid control arrangement, the fluid control arrangement being responsive to flow of the drying fluid.

12. The method of claim 11 which includes circulating the fluid relative to the drying zone by means of a fan.

13. The method of claim 11 which includes heating the drying fluid prior to entry of the drying fluid into the drying zone.

14. The method of claim 12 in which the fluid control arrangement comprises a plurality of fluid flow responsive closure members, each closure member being a normally open member which is retained in an open configuration by an urging element in the absence of fluid flow, and in which the method includes causing fluid flow to cease to cause the urging element to open its closure member.

15. The method of claim 14 which includes using the fan to assist in expelling the moisture laden fluid and the replacement of the moisture laden fluid by fresh fluid.

* * * * *

UNITED STATES PATENT AND TRADEMARK OFFICE

CERTIFICATE OF CORRECTION

PATENT NO. : 6,954,994 B1
DATED : October 18, 2005
INVENTOR(S) : Cherng Linn Teo et al.

It is certified that error appears in the above-identified patent and that said Letters Patent is hereby corrected as shown below:

Column 3,
Line 57, "dying" should read -- drying --.

Signed and Sealed this

Tenth Day of January, 2006

JON W. DUDAS
*Director of the United States Patent and Trademark Office*